US006414659B1

(12) United States Patent
Park et al.

(10) Patent No.: US 6,414,659 B1
(45) Date of Patent: Jul. 2, 2002

(54) LCD GAIN AND OFFSET VALUE ADJUSTMENT SYSTEM AND METHOD

(75) Inventors: Jeong-Sook Park, Pusan; Kye-Won Ryou, Seoul, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/545,833

(22) Filed: Apr. 10, 2000

(30) Foreign Application Priority Data

Jun. 15, 1999 (KR) ..... 99-22398

(51) Int. Cl.[7] ..... G09G 3/36
(52) U.S. Cl. ..... 345/63; 345/77; 345/214
(58) Field of Search ..... 345/63, 77, 214, 345/89

(56) References Cited

U.S. PATENT DOCUMENTS 5,298,912 A * 3/1994 Mano et al. ..... 345/88
6,151,007 A * 11/2000 Kasai et al. ..... 345/95

FOREIGN PATENT DOCUMENTS

DE 4307366 A1 * 9/1994 ..... G01D/3/02
EP 0 348 123 * 6/1989 ..... G01R/13/34

* cited by examiner

*Primary Examiner*—Amare Mengistu
(74) *Attorney, Agent, or Firm*—Robert E. Bushnell, Esq.

(57) ABSTRACT

A system is disclosed for adjusting gain and offset values to set the best-fitted gain and offset values of R, G, and B video signals, by using stable area data of a video signal input to a liquid crystal display from a computer system during the production process of a liquid crystal display. First, the gain value is initialized to the maximum and the offset value to the minimum for adjusting the gain and offset values of the video signal input. Next, the offset value is adjusted by decreasing it until data of a video signal read by a base address register set for reading the stable area data of a black area is the same as the initialized minimum data. Finally, the gain value is adjusted by increasing it until data of a video signal read by the base address register set for reading stable area data of a white area is the same as the initialized maximum data.

15 Claims, 5 Drawing Sheets

LCD GAIN AND OFFSET VALUE ADJUSTMENT SYSTEM AND METHOD

This application makes reference to, incorporates the same herein, and claims all benefits accruing under 35 U.S.C. §119 from the inventor's application SETTING METHOD FOR GAIN AND OFFSET VALUE IN LIQUID CRYSTAL DISPLAY filed with the Korean Industrial Property Office on Jun. 15, 1999 and there duly assigned Ser. No. 22398/1999.

BACKGROUND OF THE INVENTION

1. Field of the Invention

The present invention relates to a system for adjusting gain and offset values for a liquid crystal display (LCD). More particularly, the invention concerns so adjusting gain and offset values for an LCD as to set the best-fitted offset value controlling the brightness of an image displayed on a screen and the best-fitted gain value of video signals, during an LCD production process. The invention also concerns a method of using the system.

2. Description of the Prior Art

LCDs are light in weight, unlike cathode-ray tube (CRT) monitors. LCDs can be manufactured to be quite thin while nonetheless displaying an image clearly without distortion. This has made LCDs particularly useful for notebook-type computers.

An LCD adjusts its white balance in accordance with the gain of red (R) green (G), and blue (B) color signals sent to the LCD from a computer system. The light and darkness of the LCD are varied for contrasting clearly a bright image and a dark image. To provide a given brightness value for an LCD panel, it is known to establish a cut off voltage according to a bias of the R, G, and B color signals displayed on the LCD panel. Brightness is varied by generating a bias voltage, standardizing the cutoff voltage in accordance with a desired adjustment of the brightness.

FIG. 1 is a block diagram showing a construction of a liquid crystal display according to the prior art. A computer system 1 simultaneously sends video signals (R, G and B color signals) for display on an LCD screen, as well as a horizontal synchronizing signal H and a vertical synchronizing signal V.

A pre-amplifier 2 amplifies the R, G, and B color signals from the computer system 1, in accordance with a brightness-control signal from a microcomputer 4. An analog-to-digital converter (ADC) 3 receives an analog video signal from preamplifier 2 and converts it to a digital video signal according to a divide value received from a phase locked loop (PLL) 5.

Microcomputer 4 detects and divides a horizontal synchronizing signal H and a vertical synchronizing signal V sent from computer system 1. The microcomputer determines an operating mode (e.g., color graphics adapter mode (CGA), video graphics array mode (VGA), and super video graphics array mode (SVGA)) through a frequency of a divided horizontal synchronizing signal H and a divided vertical synchronizing signal V, and provides a resolution in accordance with the operating mode so determined.

In this prior art system, the frequency and resolution of horizontal synchronizing signal H and vertical synchronizing signal V vary according to the selected operating mode. For example, in the CGA mode, the frequency of horizontal synchronizing signal H is 15.75 Khz, the frequency of vertical synchronizing signal V is 60 Hz, and the resolution is 640×350. In the VGA mode, the frequency of horizontal synchronizing signal H is 31.5 Khz, the frequency of vertical synchronizing signal V is 60 Hz, and the resolution is 720×350 or 640×480. In the SVGA mode, the frequency of horizontal synchronizing signal H is 35~37 KHz, the frequency of vertical synchronizing signal V is interlace and resolution is 800×600.

Therefore, microcomputer 4 sends a horizontal synchronizing signal H and a vertical synchronizing signal V to PLL 5 and a graphics controller 6, after recognizing a resolution according to the above-mentioned modes.

The PLL varies the divide value in accordance with the resolution recognized in microcomputer 4 and sends the divide value to ADC 3.

The graphics controller adjusts the frequency of a pulse signal from the ADC 3 through a horizontal synchronizing signal H from the PLL according to a resolution recognized by the microcomputer, so that a video signal is displayed on a LCD panel 7. The pre-amplifier, the ADC, and the PLL can be separated from one another or else integrated in a chip.

In order to adjust gain and offset values in a LCD of this prior art construction, R, G, and B analog color signals are sent to ADC 3 from pre-amplifier 2. These signals are fitted to a standard level of the ADC. A bottom level and a top level are adjusted in order to fit the R, G, and B analog color signals to the standard level of the ADC 3. To do so, a bottom level is set to adjust an offset value and a top level is set by adjusting a signal width to adjust a gain value.

In using this prior art system for adjusting gain value and offset value, an external apparatus (a "Jig") typically is connected to an output line of pre-amplifier 2 and ADC 3, so that an operator can adjust gain and offset values after visually inspecting an input waveform. Also, by programming the above-described adjusting operation, gain and offset values of an input waveform can be adjusted automatically without need for an operator actually to see an input waveform. The gain and offset values can be adjusted by reading a digital output value of the ADC and setting a bottom level to "0x00" and a top level to "0xFF".

This prior art method for adjusting gain and offset values in a conventional LCD involves some inconvenience. A common environment must be established between an LCD and an external apparatus, since an operator must manually adjust gain and offset values by using his eyes.

Adjusting gain and offset values automatically by using a program also is a problematic. The best-fitted gain and offset values cannot readily be obtained, because all the area of a video signal to the ADC is considered and noise (ringing or damping phenomenon) is generated on an initial edge part of the video signal, as shown in FIGS. 2A and 2B, illustrating a waveform of a video signal to the ADC from the pre-amplifier, using the prior art system.

SUMMARY OF THE INVENTION

An object of the present invention is to provide an improved method for adjusting gain and offset values for an LCD. A further object is to obtain the best-fitted gain and offset values of R, G, and B color signals, by considering only stable area data in the waveform.

In order to achieve these objects, a method for adjusting gain and offset values for a liquid crystal display is provided. A first step is carried out for initializing a gain value to the maximum and an offset value to the minimum, in regard to gain and offset values of video signals from a computer system. In a second step, the offset value is adjusted through a comparison between the minimum data initialized in the first step and data of a video signal read by a base address register after setting the same for reading stable area data of a black area. The third step involves adjusting the gain value through a comparison between the maximum data initialized in the first step and data of a video signal read by a base address register after setting the same for reading a stable area data of a white area.

In a further embodiment, a method for adjusting gain and offset values for an LCD according to the present invention involves a first step of detecting a damping level of damping area data of a video signal from a computer system. A second step involves comparing the damping level of the damping area data detected in the first step with a damping level of damping area data stored previously in a microcomputer and deciding whether there is coinciding data. The next step involves, if there is coinciding data in the second process, setting the gain and offset data set at the damping level stored in the microcomputer, to gain and offset values in an LCD. The fourth step is, if there is no coinciding data in the second step, setting the gain and offset data set at the nearest damping level, to gain and offset values in an LCD. Then, gain and offset values are adjusted according to gain and offset values set in the third and second steps.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DETAILED DESCRIPTION OF THE PRESENT INVENTION

Figure 1:
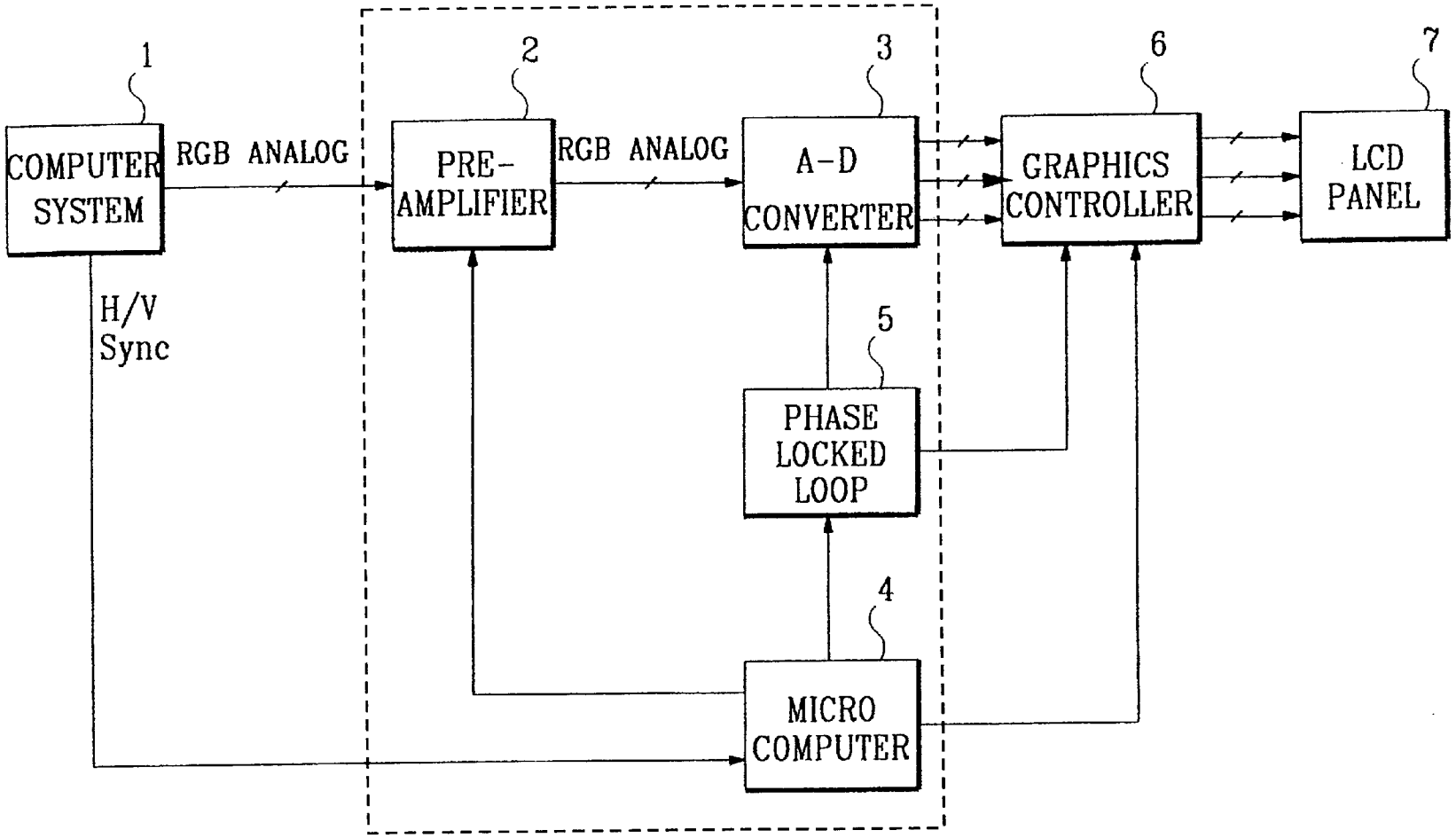
FIG. 1 is a block diagram showing a prior art construction of an LCD system.
Figure 3:
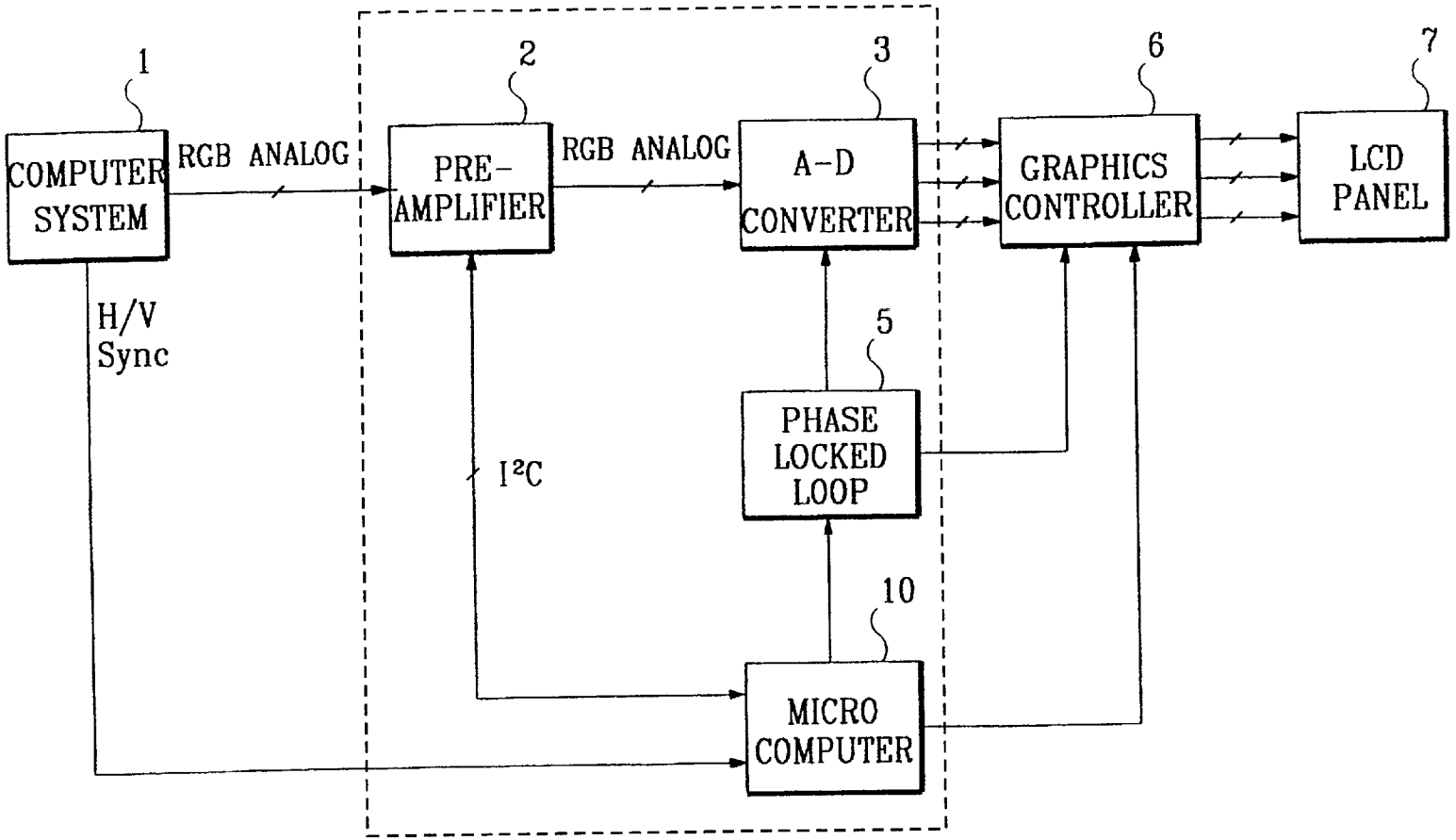
FIG. 3 is a block diagram showing the present invention.

Referring to FIG. 3, a block diagram showing an LCD system according to the present invention, it is seen that the modules of the prior art system of FIG. 1 are utilized, although the connection is somewhat different. Each part mentioned in FIG. 1 is indicated with the same number as in FIG. 1 and is therefore not described again. It should be noted that the differently connected microcomputer is designated now as element 10.

Referring further to FIG. 3, microcomputer 10 is seen to now receive input from pre-amplifier 2. A program stored in the microcomputer is adapted for adjusting gain and offset values by using stable area data of the video signals, i.e., the R, G, and B color signals sent to the pre-amplifier from computer system 1. The program adjusts the gain and offset values of the R, G, and B color signals from the pre-amplifier 2, connected to an inter integrated circuit, designated IIC, or $I^2C$, as in FIG. 3. The program controls pre-amplifier 2 to provide the adjusted R, G, and B color signals to ADC 3.

Figure 2A:
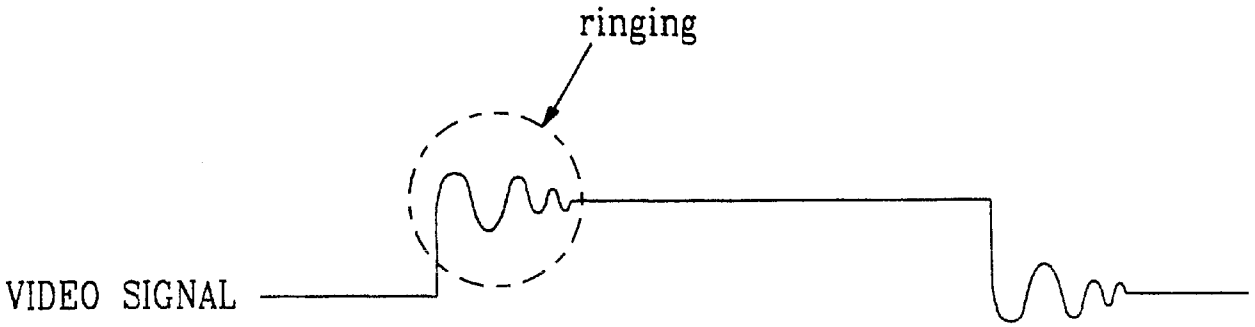
FIGS. 2A and 2B together show a waveform of a video signal from a computer system, for the prior art system of FIG. 1.
Figure 2B:
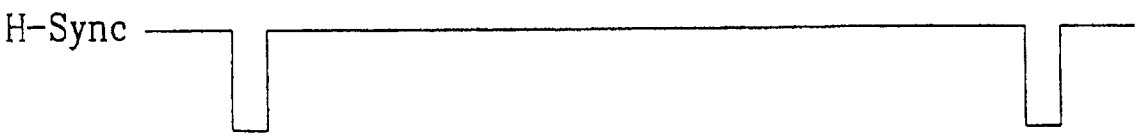

Then, a stable area of R, G, and B color signals is sent to pre-amplifier 2 from computer system 1. As shown in FIG. 2, the stable area is that following the ringing (circled with broken line in FIG. 2). This is an area without noise generated on the edge part of the R, G, and B video color signals sent into the pre-amplifier.

The stable area is influenced by the operating mode of the R, G, and B color signals. Generally, ringing noise is not generated in R, G, and B signals sent after the first several pixels of a square wave. Hence, a delay over the first several pixels avoids the noise.

Therefore, it is preferred to set the stable area to be following by a double or triple factor relative to the area where a ringing phenomenon occurs. The stable area is determined by having the program adjusting gain and offset values in microcomputer 10.

In another embodiment, after setting gain value to the maximum and offset value to the minimum, the system of the invention sets the best-fitted gain and offset values (as compared with stable area data) in the light of experimental data concerning the damping phenomenon (ringing) of the system.

Accordingly, in this embodiment, gain and offset data are adjusted each time an LCD is produced. Gain and offset values are adjusted in the actual production line. The microcomputer stores previous data as to the damping level of signals from computer system 1. Gain and offset data adjusted when a video signal of a corresponding damping level appears as input. The damping level is detected for a video signal input to the LCD. The detected damping level is compared with the data stored previously in microcomputer 10. According to the result of this comparison, gain and offset values are adjusted to gain and offset levels adjusted for the corresponding damping level.

Figure 4:
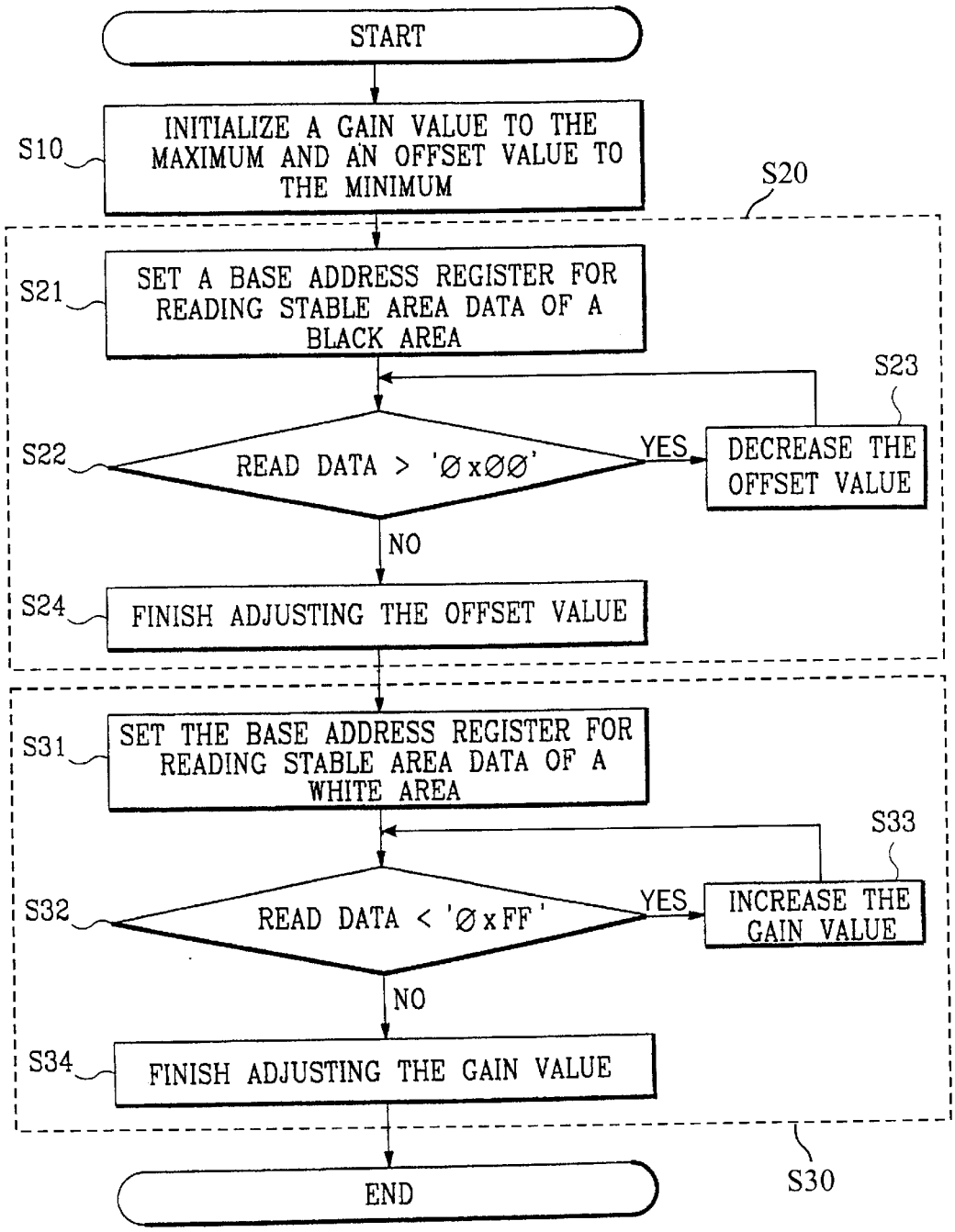
FIG. 4 is a flowchart showing an embodiment of a method for adjusting gain and offset values for an LCD system of the present invention.
Figure 5:
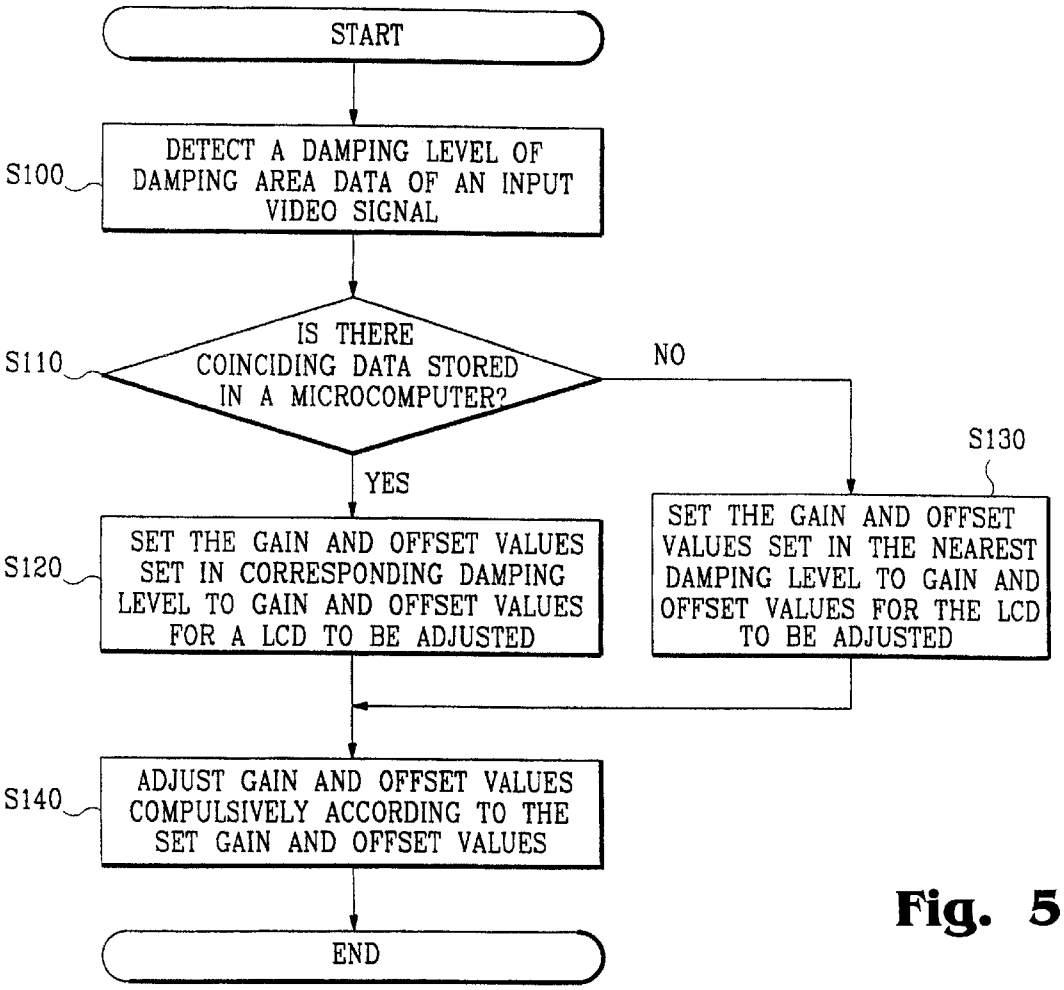
FIG. 5 is a flowchart showing another embodiment of a method for adjusting gain and offset values for an LCD system of the present invention.

This procedure is now explained with reference to flowchart FIGS. 4 and 5. FIGS. 4 and 5 are flowcharts illustrating a method for adjusting gain and offset values according to the present invention.

Referring to FIG. 4, it is seen that in the first step (S10) a gain value is initialized to the maximum ($G_{max}$) and an offset value to the minimum ($O_{min}$). That is, the system initializes the gain value to "0x00" and the offset value to "0xFF".

After initializing the gain and offset values, a base address register is set to read stable area data of a black area (Db) of R, G, and B color signals inputted for adjusting the offset value. This is step S21.

Next is step S22, it is determined whether data of a video signal read by the base address register is greater than the minimum data initialized in above step S10.

If the data read by the base address register is greater than the minimum data in step S22, the offset value is decreased in step S23 to get the best-fitted offset value. However, if the data read by the base address register is the same as or less than the minimum data, the value is set to the offset value in step S24, and adjustment of the offset value is finished.

After the offset value is adjusted in step S24, the base address register is set to read stable area data for a white area ($D_w$) of R, G, and B color signals to adjust the gain value. This is step S31.

In following step S32, it is determined whether the data read by the base address register set in step S31 is less than the maximum data initialized in step S10. If the data read by the base address register is less than the maximum data, the gain value is increased in step S33 to get the best-fitted gain value. If the data read by the base address register is the same as or greater than the maximum data, the value is set in step S34 to the gain value and adjustment of the gain value is finished. That ends the process.

Referring to FIG. 5, illustrating steps for adjustment of gain and offset values with reference to experimental data about the damping phenomenon, it is seen that first step S100 involves detecting damping level of damping area data of the R, G, and B video signals. In step S110, the damping level of the damping area data detected in step S100 is compared with a damping level of damping area data stored previously in microcomputer 10. Then it is decided whether there is coinciding data. In the microcomputer 10 data are stored for the damping level of damping area data of a video signal from computer system 1 to an LCD and gain and offset data adjusted at the time of input of a video signal of data about the corresponding damping level. If there is coinciding data in the step 110 S110, gain and offset data that are set at the corresponding damping level stored in the microcomputer 10, are set to gain and offset values of an LCD to be adjusted. However, if there is no coinciding data in the step S110, gain and offset data adjusted in step S130 at the nearest damping level are set to gain and offset values of an LCD to be adjusted. According to the gain and offset values set in steps S120 and S130, gain and offset values are adjusted in step S140, and adjustment of gain and offset values is finished. The process ends.

As stated above, since the base address register showing an area of a video signal input from the computer system to the LCD is set to a stable area, and only the stable area data are utilized for adjusting gain and offset values, it is possible to set the best-fitted gain and offset values so that they are influenced minimally by the noise generated on the edge part of the video signal. The result is to decrease deviation among R, G, and B color signals.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

What is claimed is:

1. A method for automatically adjusting gain and offset values for a liquid crystal display (LCD), the method comprising the steps of:

(1) initializing a gain value to a maximum level $G_{max}$, and an offset value to a minimum level $O_{min}$, for a video signal to be sent to the LCD as input;

(2) setting a base address register to read stable area data of a black area of the video signal;

(3) reading the video signal into the base address register to provide stable area data $D_b$ of a black area;

(4) comparing the stable area data $D_b$ of a black area with $O_{min}$ to adjust an offset value $V_{off}$ for the video signal;

(5) setting the base address register to read stable area data of a white area of the video signal;

(6) reading the video signal in the base address register to provide stable area data $D_w$ of a white area; and (7) comparing the stable area data $D_w$ of a white area with $G_{max}$ to adjust a gain value $V_{gain}$ for the video signal.

2. The method of claim 1, wherein step (4) comprises the steps of:

(a) determining whether the stable area data $D_b$ read in step (3) has a value such that $D_b \leqq O_{min}$;

(b) if $D_b \leqq O_{min}$, decreasing offset value $V_{off}$ for the video signal until the stable area data $D_b \leqq O_{min}$; and (c) if $D_b \leqq O_{min}$, finishing adjustment of the offset value $V_{off}$.

3. The method of claim 1, wherein step (7) comprises the steps of:

(a) determining whether the stable area data $D_w$ read in step (6) has a value such that $D_w < G_{max}$;

(b) if $D_w < G_{max}$, increasing the gain value $V_{gain}$ for the video signal until the stable area data $D_w \geqq G_{max}$; and (c) if $D_w \geqq G_{max}$, finishing adjustment of the gain value $V_{gain}$.

4. The method of claim 1, wherein $O_{min}$ is "0×00" and $G_{max}$ if "0×FF".

5. The method of claim 1, wherein the video signal data of steps (2) to (7) is a unit pixel.

6. The method of claim 1, wherein the stable area data are portions of R, G, and B waveforms free from ringing.

7. The method of claim 6, wherein the stable area data for a video signal are defined in relation to a plotted waveform of the video signal, wherein $T_o$ is a time at which the signal first reaches its maximum value, $T_r$ is a time interval following $T_o$ during which ringing occurs, and the stable area data begin at a time $T_s$ such that $T_s \geqq T_o + 2T_r$.

8. The method of claim 1, wherein the stable are data for a video signal are defined in relation to a plotted waveform of the video signal, wherein $T_o$ is a time at which the signal first reaches its maximum value, $T_r$ is a time interval following $T_o$ during which ringing occurs, and the stable area data begin at a time $T_s$ such, that $T_s \geqq T_o + 2T_r$.

9. A method for automatically adjusting gain and offset values for a liquid crystal display (LCD), the method comprising the steps of:

(1) Storing a damping level datum for a video signal in a memory available to a microcomputer, whereby a stored damping level datum is provided;

(2) detecting a damping level datum for a video signal to be sent to the LCD as input, whereby a detected damping level datum is provided;

(3) comparing the detected damping level datum with the stored damping level datum, by means of the microcomputer to which the memory is available, to determine whether the data coincide;

(4) if the data coincide, setting the gain and offset values for the LCD at the value of the stored damping level datum;

(5) if the data do not coincide, setting the gain and offset values for the LCD at a level nearest to the detected damping level datum; and (6) finishing adjustment of the the gain and offset values.

10. The method of claim 9 wherein the microcomputer compares the data, and the gain and offset values are adjusted, at a time when a video signal corresponding to the detected damping level datum is input to the LCD.

11. A system for automatically adjusting gain and offset values for a liquid crystal display (LCD), the system comprising:

a means for initializing a gain value to a maximum level $G_{max}$ and an offset value to a minimum level $O_{min}$, for a video signal to be sent to the LCD as input;

a means for setting a base address register to read stable area data of a black area of the video signal;

a means for reading the video signal in the base address register to provide stable area data $D_b$ of a black area;

a means for comparing the stable area data $D_b$ of a black area with $O_{min}$ to adjust an offset value $V_{off}$ for the video signal;

a means for setting the base address register to read stable area data of a white area of the video signal;

a means for reading the video signal in the base address register to provide stable area data $D_w$ of a white area; and a means for comparing the stable area data $D_w$ of a white area with $G_{max}$ to adjust a gain value $V_{gain}$ for the video signal.

12. The system of claim 11, wherein the means for comparing the stable area data $D_b$ with $O_{min}$ comprises:

a means for determining whether the stable area data $D_b$ read in step (3) has a value such that $D_b \leqq O_{min}$;

if $D_b \leqq O_{min}$, a means for decreasing offset value $V_{off}$ for the video signal until the stable area data $D_b \leqq O_{min}$; and if $D_b \leqq O_{min}$, a means for finishing adjustment of the offset value $V_{off}$.

13. The system of claim 11, wherein the means for comparing the stable area data $D_w$ with $G_{max}$ comprises a means for determining whether the stable area data $D_w$ read in step (6) has a value such that $D_w < G_{max}$;

if $D_w < G_{max}$, a means for increasing the gain value $V_{gain}$ for the video signal until the stable area data $D_w \geqq G_{max}$; and if $D_w \geqq G_{max}$, a means for finishing adjustment of the gain value $V_{gain}$.

14. The system of claim 11, wherein Omin is "0×00" and Gmax is "0×FF".

15. A system for automatically adjusting gain and offset values for a liquid crystal display (LCD), the system comprising:

a microcomputer and a memory available thereto;

a means for storing a damping level datum for a video signal in the memory;

a means for detecting a damping level datum for a video signal to be sent to the LCD as input, whereby a detected damping level datum is provided;

a means for comparing the detected damping level datum with the stored damping level datum, by means of the microcomputer to which the memory is available, to determine whether the data coincide;

if the data coincide, a means for setting the gain and offset values for the LCD at the value of the stored damping level datum; and if the data do not coincide, a means for setting the gain and offset values for the LCD at a level nearest to the detected damping level datum.

* * * * *